US005413065A

United States Patent [19]

Spragg et al.

[11] Patent Number: 5,413,065

[45] Date of Patent: May 9, 1995

[54] FLEXIBLE FABRIC BARGE

[75] Inventors: Terry G. Spragg, 420 Highland Dr., Manhattan Beach, Calif. 90266; Clifford A. Goudey, Charlestown, Mass.

[73] Assignee: Terry G. Spragg, Manhattan Beach, Calif.

[21] Appl. No.: 103,287

[22] Filed: Aug. 6, 1993

[51] Int. Cl.[6] ..... B63B 35/28

[52] U.S. Cl. ..... 114/256; 114/26; 114/74 T

[58] Field of Search ..... 114/256, 253, 254, 77 A, 114/242, 26, 74 A, 77 R, 74 R, 74 T, 345; 941/35, 44, 45, 133

[56] References Cited

U.S. PATENT DOCUMENTS

| | | | |
|---|---|---|---|
| 2,999,253 | 9/1961 | Lewis | 114/345 |
| 3,067,712 | 12/1962 | Doerpinghaus | 114/74 T |
| 3,679,025 | 7/1972 | Rummel | 441/44 |
| 3,774,563 | 11/1973 | Anderson, Sr. et al. | 114/256 |
| 3,779,196 | 12/1973 | Knaus et al. | 114/256 |

*Primary Examiner*—Stephen P. Avila
*Attorney, Agent, or Firm*—Seed and Berry

[57] ABSTRACT

Flexible fabric barges are connected together in a string for towing. The barges are interconnected by fabric sleeves which have zipper connections. A fabric towing cone is zipper connected to the lead barge.

7 Claims, 2 Drawing Sheets

FLEXIBLE FABRIC BARGE

TECHNICAL FIELD

The present invention relates to flexible fabric barges used singly or towed in a string.

BACKGROUND OF THE INVENTION

The use of flexible fabric barges has been proposed for storage of oil recovered from an oil spill and for transporting fresh water in a salt water body of water. The latter use potentially involves the transporting of huge amounts of fresh water, possibly in a hostile wind and wave environment, and over distances which may be well in excess of a thousand miles between a supply port a discharge port. The present invention aims to provide a reliable and practical water delivery system utilizing flexible barges which is cheaper than use of rigid sea or land tankers or pipelines.

SUMMARY OF THE INVENTION

The present invention recognizes that to economically transport fresh water by sea using flexible fabric barges it is advantageous to tow several barges in a string with each barge being from 25 to 50 feet in diameter and from 200 to 800 feet in length, and that for loading and unloading purposes at docking sites, the barges should be easily coupled and separated when filled.

In accordance with the invention a series of fabric barges are connected together by fabric sleeves and suitable connecting elements, preferably zippers. The lead barge is preferably connected to a tow line by a fabric nose cone. Preferably each barge has a collar at both ends and the sleeves are zipper connected to the collars The front collar on the lead barge can be zipper connected to the nose cone. The opposite end portions of each barge preferably have the same configuration and the main body portion of each barge is generally cylindrical.

Detailed Description of the Invention

Figure 1:
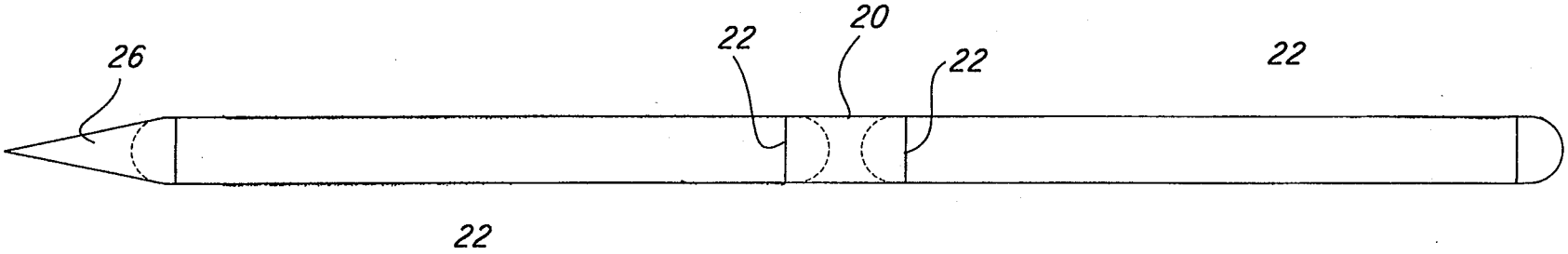
FIG. 1 is a side elevational view showing two barges coupled together in accordance with the present invention.

Referring to the drawings, a barge 10 is illustrated having a central main body 12 which is cylindrical if filled. The main body 12 is preferably fabricated from multiple rectangular fabric sections 12*a* which are joined along longitudinal seams 14. At its ends the main body 12 is joined to respective bulbous end portions 16 of like design at circumferential seams. At or adjacent these circumferential seams the main body 12 is joined to collars 18 in the preferred embodiment. These collars are used in conjunction with fabric sleeves 20. The collars and sleeves have complementing sets 22 so that the collars and sleeves of components for zippers can be easily connected together. A fabric nose tow cone 24 is provided with a set of zipper components to register with the zipper components on the front collar 20 of the lead barge. This nose cone is reinforced at the nose and connected to a suitable towing fitting 26 or bridle.

As an alternative arrangement, for example, the sleeves 22 can be permanently connected at one end to the collar at one end of a respective barge, and zipper connected at its other end to the collar at the other end of a like barge.

As still another alternate, the collars 20–21 can be extended as sleeve extensions having a length of about one-half that of the sleeves 22, and have a set of zipper components mounted at their free ends to connect the sleeve extensions together. With this arrangement the zipper connections would be located midway between adjacent barges.

The zipper connection of the sleeves 20 is not water tight so that sea water will be between the ends of the barges to act as a cushion. Similarly, the forward end of the nose cone 24 is open sufficiently to permit the nose cone to be full of sea water.

Figure 2:
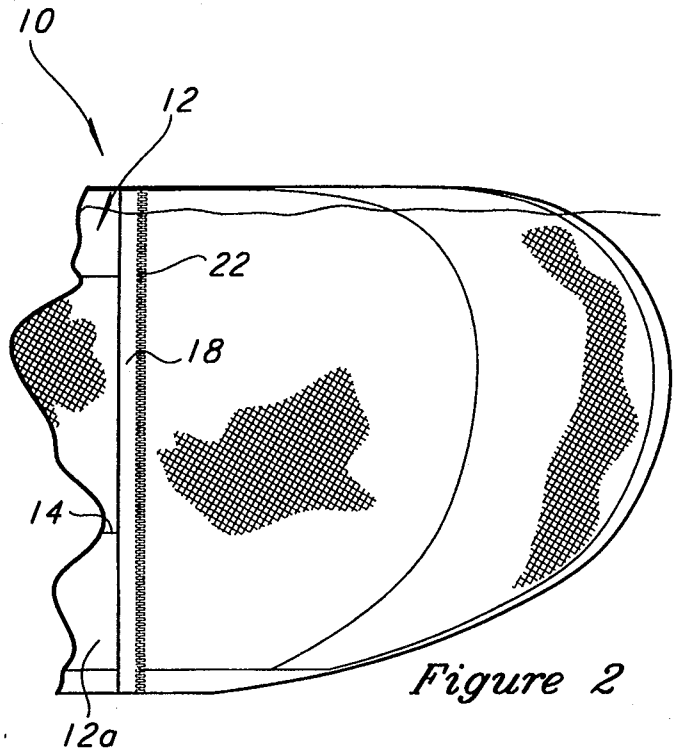
FIG. 2 is a side elevational view of an end portion of one of the barges when about 90% full of fresh water.
Figure 3:
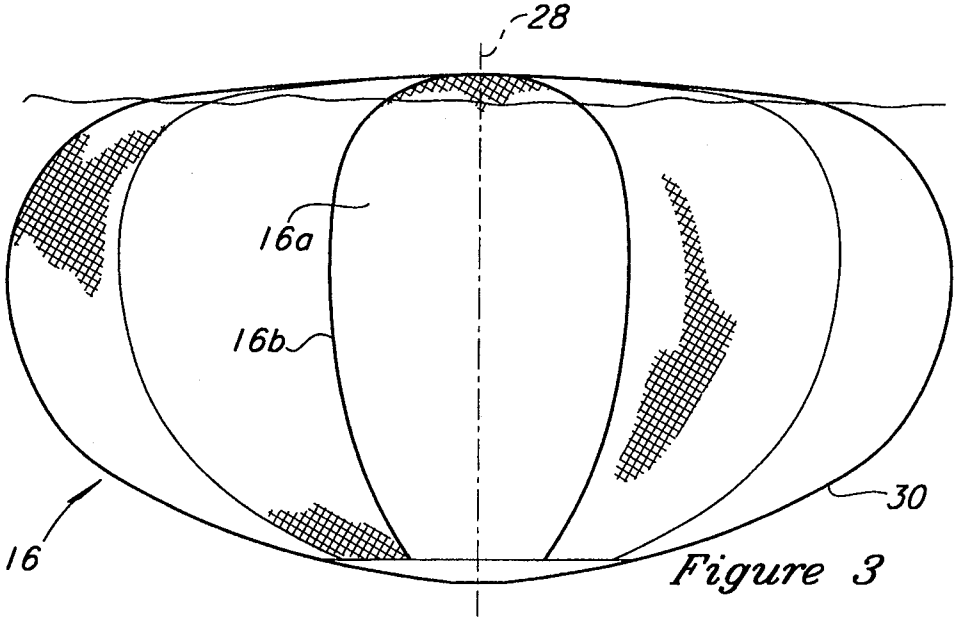
FIG. 3 is a front elevational view of the end of the barge shown in FIG. 2.
Figure 4:
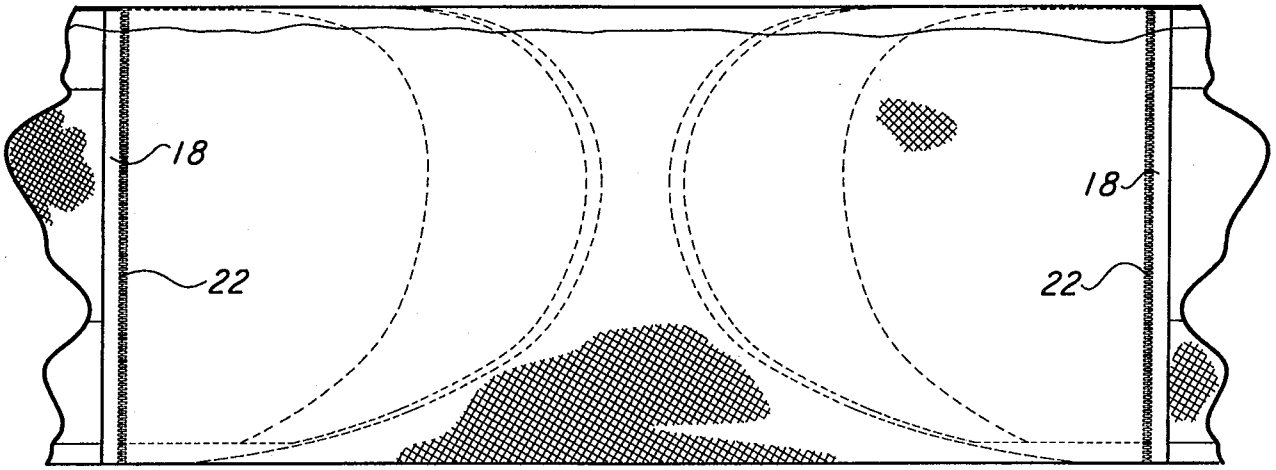
FIG. 4 is a fragmentary side elevational view showing the sleeve connection between barges.
Figure 5:
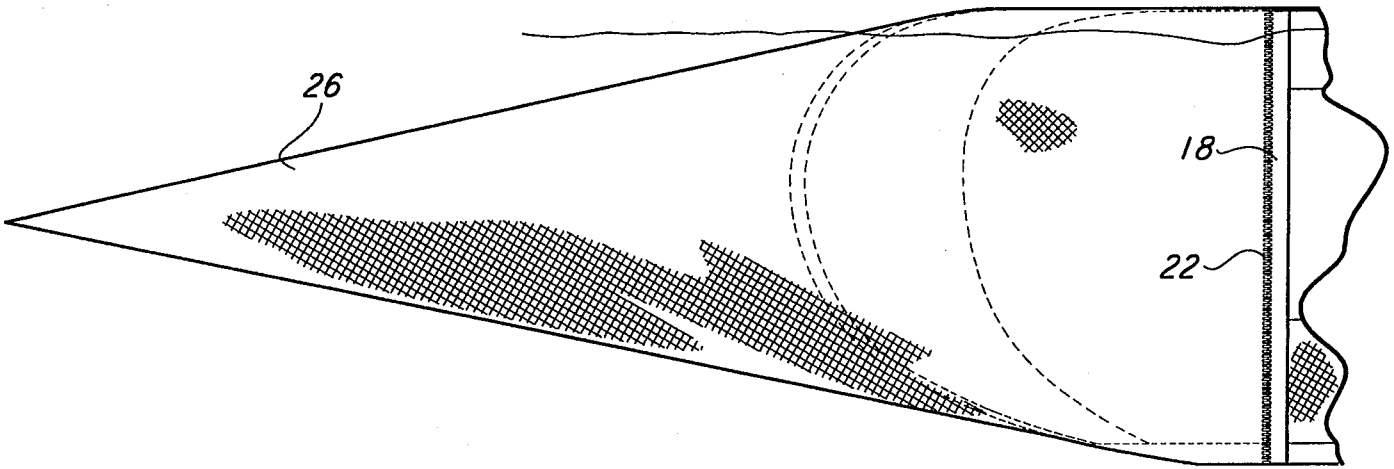
FIG. 5 is a fragmentary side elevational view showing the nose cone in operating position.

The barges will normally be 90% full of fresh water and hence will have a transverse "filled" profile which is laterally distorted as indicated in FIGS. 2–3. Referring to FIG. 3, it is preferred that the front and rear portions 16 of the barge have the shape of the front half and rear half, respectively of the surface of a three-dimensional body of rotation having the vertical center line 28 of the main body portion 12 as an axis of rotation and the main body profile 30 at the transverse location as the generatrix when the barge is 90% full. The end portions 16 can be fabricated by subdividing them into multiple fabric sections 16*a* joined at seams 16*b*.

The zippers 22 have sets of large individual plastic teeth elements fixed on respective two-ply woven fabric mounting strips each enclosing a cord along a longitudinal side edge portion. The cord preferably has a stainless steel core surrounded by a PVC sleeve. The teeth elements are confined against movement relative to their mounting strip by the cords. The two-plies of each mounting strip straddle end portions of the respective sleeve collar 18 and are welded or other mounted thereto. The teeth elements are molded from a suitable plastic and may be of standard shape for interfitting responsive to gliding of the slide element. The slide element stays with one of the sets of zipper teeth and is interfitted with an entry portion of the complementing mounting strip. This may be accomplished by a diver. The zippers 22 may be opened and closed by a diver or by a machine moving the slide element.

The barges are provided with one or more ports for filling and emptying. These ports can comprise large grommets, about 12 inches in diameter, which are secured in a water tight connection to the rims of appropriate openings in the barge fabric. The grommets are internally threaded to receive removeable threaded plugs.

It will be appreciated from the foregoing description that two or more barges can be easily connected together to be towed in a string with the lead barge being fitted with the tow cone 26. At the delivery site the barges can be easily disconnected from one another and maneuvered to an unloading station.

We claim:

1. A set of flexible barges for transporting cargo therein comprising:

a front flexible barge comprising a first elongated cargo container of flexible fabric construction;

a towing cone connected to said front barge adjacent the forward end thereof;

a back flexible barge comprising a second elongated cargo container of flexible fabric construction;

a flexible fabric towing sleeve connecting said first container in towing relationship to said second container with said containers spaced apart endwise, said sleeve Being interconnected with said towing cone only via the fabric of said container;

and releasable fastening elements on said sleeve for optionally disconnecting said barges from one another, the flexible fabric of said containers and sleeve being arranged and adapted to sustain the entire towing load resulting from applying a towing force to said towing cone while both barges are loaded with cargo.

2. A set of flexible barges according to claim 1 in which said fastening elements comprise zipper teeth elements.

3. A set of barges according to claim 1 in which said containers each have a generally cylindrical main body section and end closures, and in which said sleeve is connected to adjacent ends of said main body sections.

4. A set of barges according to claim 3 in which said towing cone is connected to the main body section of said front cargo container.

5. A set of barges according to claim 1 in which said cargo is fresh water and said barges are in a body of salt water.

6. A flexible barge for transporting liquid cargo having a density less than the water in the body of water in which the barge is being used, said barge comprising:

a watertight flexible container of flexible fabric construction having an elongated main body section, and having first and second end closure sections connected to first and second ends of said main body section;

a flexible fabric towing sleeve connected by an inner end to said container adjacent said second end of said main body section and extending endwise to an outer end spaced endwise from said second end closure section;

a towing connection at said first end of the main body section, the flexible fabric of said container being arranged and adapted to sustain and transfer to said towing sleeve all towing forces exerted at said towing connection whereby a second such container can be towed by said first container when the second container is connected to said outer end of the sleeve.

7. A flexible barge according to claim 6 in which said sleeve contains a zipper extending around the sleeve.

* * * * *